United States Patent [19]

Steinort et al.

[11] 4,134,553

[45] Jan. 16, 1979

[54] GRINDING APPARATUS

[75] Inventors: Eberhart Steinort; Armando Lazzari; Alfredo Cartoceti, all of Malgesso, Italy

[73] Assignee: I.O.S. Industria Ossidi Sinterizzati S.r.l., Varese, Italy

[21] Appl. No.: 801,314

[22] Filed: May 27, 1977

[30] Foreign Application Priority Data

Nov. 2, 1976 [IT] Italy ..... 28931 A/76

[51] Int. Cl.[2] ..... B02C 17/06

[52] U.S. Cl. ..... 241/34; 241/153; 241/170

[58] Field of Search ..... 241/34, 153, 170, 171, 241/172, 179

[56] References Cited

U.S. PATENT DOCUMENTS

| | | | |
|---|---|---|---|
| 2,175,321 | 10/1939 | Saffir | 241/172 |
| 2,350,534 | 6/1944 | Rosinger | 241/172 U X |
| 3,596,839 | 8/1971 | Putman | 241/34 X |
| 3,860,804 | 1/1975 | Rutman | 241/34 X |
| 3,942,727 | 3/1976 | Fahlstrom et al. | 241/34 |
| 3,987,967 | 10/1976 | Kuznetsov et al. | 241/170 X |

FOREIGN PATENT DOCUMENTS

| | | | |
|---|---|---|---|
| 280218 | 1/1971 | U.S.S.R. | 241/170 |
| 466047 | 8/1975 | U.S.S.R. | 241/170 |

*Primary Examiner*—Howard N. Goldberg
*Attorney, Agent, or Firm*—Gifford, Chandler, Van Ophem, Sheridan & Sprinkle

[57] ABSTRACT

Grinding apparatus comprising a container, means for generating a magnetic field within the container, and means for varying the magnetic field to cause relative movement between material to be ground and grinding medium in the container, at least one of the grinding medium and material to be ground being magnetic material, and the container being substantially of non-magnetic material, such as rubber or plastics.

8 Claims, 2 Drawing Figures

GRINDING APPARATUS

BACKGROUND OF THE INVENTION

I. Field of the Invention

The present invention relates to grinding apparatus.

II. Description of the Prior Art

Our earlier application, U.S. application Ser. No. 801,064 describes a method of and apparatus for grinding ferromagnetic material wherein the material to be ground and/or the grinding medium, e.g. balls, are in whole or in part made of ferromagnetic material. The material to be ground and the grinding medium are subjected to the influence of a variable magnetic field capable of promoting relative movement between at least part of the contents of the grinding chamber. Also forming the object of the above-mentioned earlier application were several apparatuses for carrying out the method and comprising at least one grinding chamber (preferably several) containing grinding medium of ferromagnetic material, such grinding medium consisting of bodies capable of being magnetically polarized, and means capable of creating in each grinding chamber a variable or mobile magnetic field.

Experiments with and evaluation of the method and apparatuses of the earlier application have confirmed the merits, efficiency and durability of the characteristics of the method and apparatus. However, certain improvements have been found desirable. In particular, it has been observed that the grinding chamber, if made of metallic material, can disturb (because of parasitic currents) the magnetic field and thus the process of propulsion of the grinding media, in addition to creating other problems.

The second observation made is that the induced magnetic field, produced for the propulsion of the grinding medium, tends to detain the magnetic particles to be ground in the grinding zone until they are ground so fine as to be capable of being carried by the flow of the grinding carrier which is generally the water in a wet grinding process or the air in a dry grinding process.

SUMMARY OF THE PRESENT INVENTION

The invention provides grinding apparatus comprising a container, means for generating a magnetic field within the container, and means for varying the magnetic field to cause relative movement between material to be ground and a grinding medium in the container, and further comprising a magnetic grinding medium and/or magnetic material to be ground, although said container is substantially made of a non-magnetic material.

The invention also provides a continuous grinding apparatus comprising a series of separate grinding chambers interconnected by a means for feeding the material to be ground into each grinding chamber or a means for regulating the flow of a fluid carrier which feeds the material to be ground into each grinding chamber.

In a preferred embodiment of the invention, both the means for regulating the magnetic field and the means for regulating the feeding flow are connected to a function generator in order to maintain a consistent fineness of the product material. Experimentation has shown that the fineness of the final product is a function of magnetic field intensity and the rate at which the material to be ground is fed into the grinding chamber.

Therefore, a product of a constant fineness may be produced in the manner demonstrated hereinafter.

Preferably a plurality of grinding chambers are provided and arranged in a series. This has the advantage that the magnetic field can be regulated to act more effectively on the grinding medium within each grinding chamber and increases control over the fineness of the product.

BRIEF DESCRIPTION OF THE DRAWING

The invention will be described further, by way of example, with reference to the accompanying drawings, wherein.

DESCRIPTION OF A PREFERRED EMBODIMENT

Figure 1:
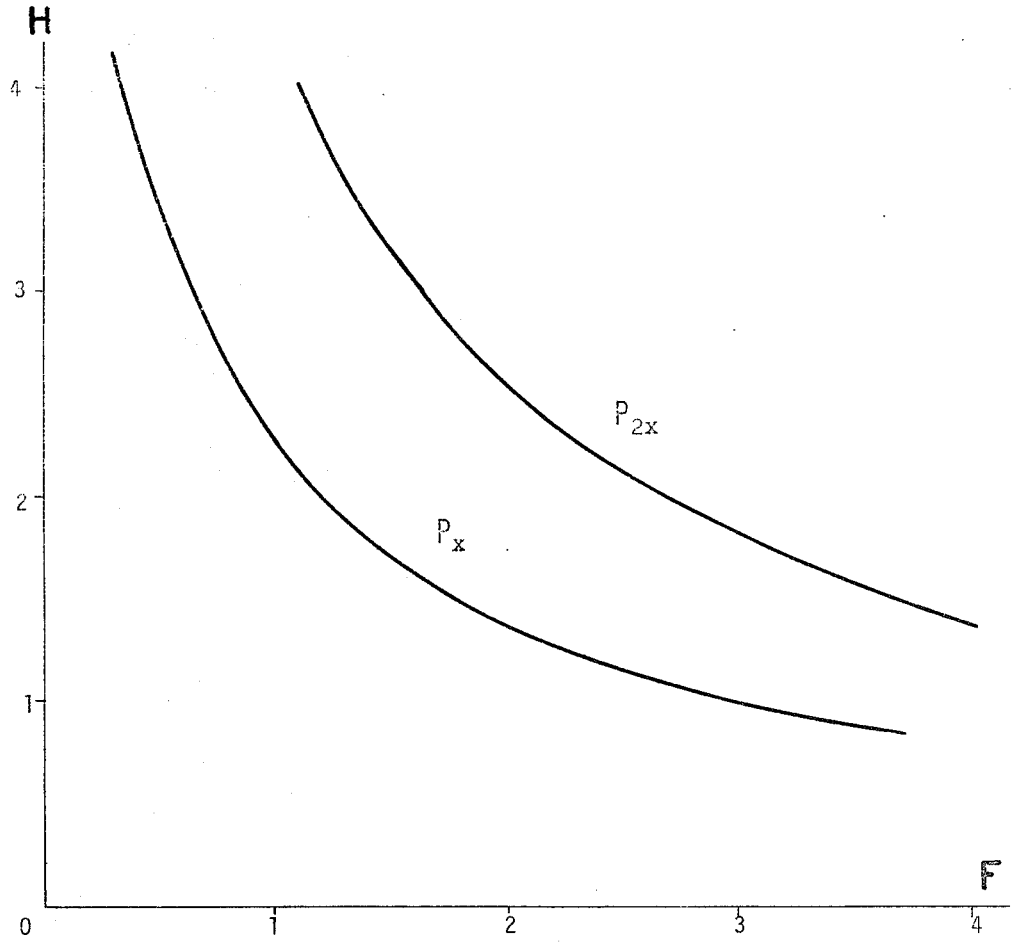
FIG. 1 is a graph showing the function which relates the fineness F to the magnetic field H and to the delivery rate of the feed means P (pump) for the material to be ground, the initial fineness of which is assumed to be constant.

In FIG. 1, there is represented the function $F=f(H,P)$ where:

F represents the fineness of the ground product which emerges from the grinding chamber;

H represents the intensity of the magnetic field for propulsion of the grinding medium in the grinding chamber;

P represents the rate of feed of the material to be ground.

The graph illustrates in arbitrary units ordinates representing the intensity of the magnetic field H and abscissae representing the fineness F. Each of the two curves traced on the graph represents the course of the function $F=f(H,P)$ in correspondence with the flows $p=x$ and $p=2x$. As will be seen in what follows, assuming that the user of the apparatus wishes to produce a product of a specific fineness, he can fix at will either the magnetic field H or the rate of the flow P and based on the graph of FIG. 1 determine the value to be assigned to the other variable. Such an operation, as is expounded hereinafter, can be developed in known manner by a function generator.

Figure 2:
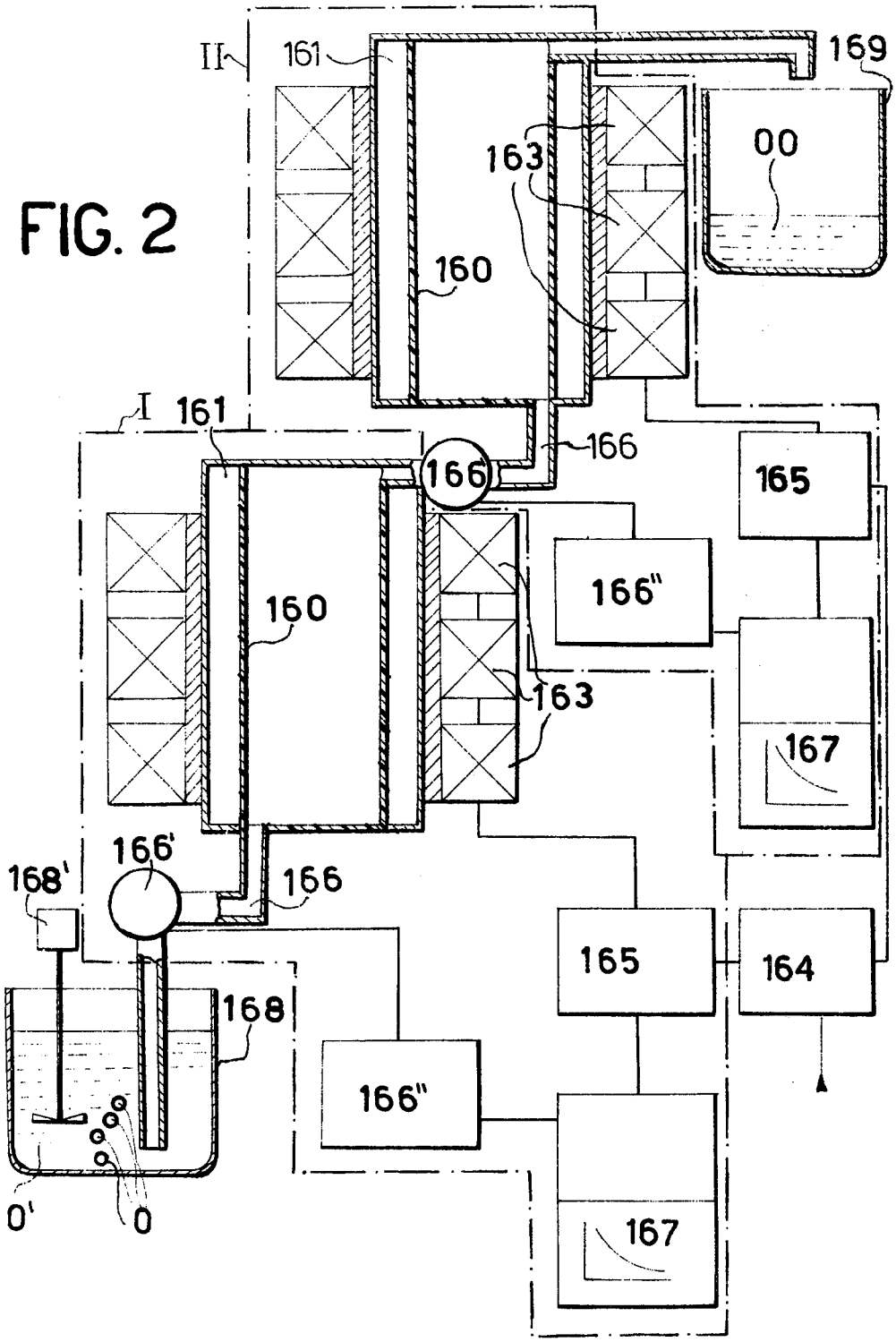
FIG. 2 is a schematic view of a preferred automatic continuous apparatus of the invention, having two grinding chambers in series.

The apparatus of FIG. 2 is substantially a combination of two devices of the type shown in FIG. 9 of our earlier U.S. application Ser. No. 801,064. In both devices, a chamber 160 of cylindrical shape, the walls of which will be made, in accordance with the present invention, of nonmetallic material and preferably of rubber or plastic material, constitutes the grinding chamber. Around the chamber 160 there is an annular cooling chamber 161. This second chamber 161 is surrounded by coils 163 for creation of the magnetic field. These coils 163 are fed by a current feeder 164 via a frequency and current control 165, which will be discussed hereinafter. At the bottom of the grinding chamber there is connected a tube 166 connected with a means 166' for feeding the material to be ground. There are two possible processes, either (a) the grinding process is wet, in which case a substantially liquid mixture will be fed into the chamber 160 by a standard hydraulic pump 166'; or (b) the grinding process is dry, in which case the material is fed into the chamber 160 by means of an Archimedean screw replacing the pump 166' in conjunction with or alternatively by a current of forced air at the inlet and/or inside the grinding chamber 160.

To the feed mechanism 166' there is connected mechanism 166'' for regulating the flow of material to be ground. The regulation of the induced magnetic field H is provided by unit 165 as described in our aforementioned earlier application. In the present invention, regulation of the feed means will produce the desired final fineness in the presence of a fixed magnetic field strength. This is done by means of a function generator 167 which is connected to the two regulation mechanisms 165 and 166'', and on which the desired fineness is set. In FIG. 2, the apparatus is shown subdivided into two parts designated by the perimeters I and II. Each part contains a device substantially equal to the other one with parts marked by the same numbers and having the same function but with the following distinctions. Mechanism 166' (II) is a flow measurer as compared to 166' (I) which is a fluid feeder. Mechanism 166'' (II) is a comparator and is, therefore, distinguished from 166'' (I) which is a feed regulation device. The apparatus can have any number n of parts illustrated by blocks I and II. In the case of wet grinding illustrated in FIG. 2, a feed tank 168 contains an agitator 168' which mechanically suspends the particles to be ground O in the liquid carrier O' keeping the mixture homogeneous prior to feeding the solution into the first chamber 160. A collecting receptacle 169 for the ground product OO is provided after the final nth part. The operation of the plant is as follows.

In a wet process for the grinding of magnetic particles O, such as the ferrites of barium, strontium or lead, it is necessary for the particles themselves to be mixed with a predetermined quantity of liquid, for example, water, and introduced into the receptacle 168, which has an agitator 168'. The chamber 160 is loaded with grinding medium in the form of spheres or the like. Assuming that the apparatus consists of two parts I and II, as shown in FIG. 2, the diameter of the grinding bodies and the volume of the grinding chambers 160 are determined by experienced calculation with regard to the fineness desired in the final product. The function generators 167(I) and 167(II) will, therefore, be set respectively to an intermediate value of fineness and to the final value of fineness desired. Then the pump 166' will be started and operated at the desired production speed. The function generator 167 (I) will calculate the field H(I) and the function generator 167(II) will calculate the field H(II) necessary to obtain the desired intermediate and final finenesses.

The system is provided with sensors which permit an automatic regulation of the grinding. Connected to the function generator 167(II) is a comparison device 166''(II), which compares the values of the function with the values obtained from the sensors. From the result of the comparison, signals may be generated by conventional feedback equipment to control the delivery capacity and/or the magnetic fields of the various chambers.

The invention is not limited to the precise details of the foregoing specific description and variations can be made thereto within the scope of the following claims.

We claim:

1. A grinding apparatus for grinding a working material by magnetically propelling a magnetic material into said work material, said apparatus comprising:

a container defining an interior grinding chamber having an input and an output, said container being made of a nonmagnetic material;

means for feeding the working and magnetic materials to the input of the grinding chamber at a variable feed rate;

means for generating a variable intensity and oscillating magnetic field within said container to cause relative movement between said working material and said magnetic material; and means for controlling the intensity of said magnetic field generated by said generating means and the feed rate of said feed means in accordance with a predetermined function to produce the working material with a preselected fineness at the output of the grinding chamber.

2. The invention as defined in claim 1 wherein the working material and the magnetic material are the same.

3. An apparatus according to claim 1 wherein said nonmagnetic container material is rubber.

4. An apparatus according to claim 1 wherein said nonmagnetic container material is a plastic.

5. The invention as defined in claim 1 and further comprising at least one further grinding apparatus of the type defined in claim 9, wherein the grinding chamber output from the first mentioned grinding apparatus is connected to the feeding means of the further apparatus.

6. The invention as defined in claim 5 and further comprising a fluid carrier for said working material.

7. The apparatus according to claim 1 wherein the controlling means is regulated by a function generator.

8. The apparatus according to claim 7 wherein said function generator comprises at least one control member which regulates the fineness desired for the working material at the grinding chamber output.

* * * * *

UNITED STATES PATENT AND TRADEMARK OFFICE

CERTIFICATE OF CORRECTION

PATENT NO. : 4,134,553

DATED : January 16, 1979

INVENTOR(S) : Eberhart Steinort, Armando Lazzari, and Alfredo Cartoceti

It is certified that error appears in the above-identified patent and that said Letters Patent are hereby corrected as shown below:

Column 4, line 40, delete "9" and insert --1-- therefor;

Signed and Sealed this

*Eighth* Day of *May 1979*

[SEAL]

*Attest:*

RUTH C. MASON
*Attesting Officer*

DONALD W. BANNER
*Commissioner of Patents and Trademarks*